US009643817B2

(12) United States Patent
Räsänen et al.

(10) Patent No.: US 9,643,817 B2
(45) Date of Patent: May 9, 2017

(54) ELEVATOR ARRANGEMENT

(71) Applicants: Matti Räsänen, Hyvinkaa (FI); Pentti Alasentie, Espoo (FI); Markku Haapaniemi, Helsinki (FI); Osmo Björni, Hyvinkaa (FI); Markku Häivälä, Hyvinkaa (FI); Aki Metsänen, Hyvinkaa (FI)

(72) Inventors: Matti Räsänen, Hyvinkaa (FI); Pentti Alasentie, Espoo (FI); Markku Haapaniemi, Helsinki (FI); Osmo Björni, Hyvinkaa (FI); Markku Häivälä, Hyvinkaa (FI); Aki Metsänen, Hyvinkaa (FI)

(73) Assignee: KONE CORPORATION, Helsinki (FI)

( * ) Notice: Subject to any disclaimer, the term of this patent is extended or adjusted under 35 U.S.C. 154(b) by 572 days.

(21) Appl. No.: 14/053,895

(22) Filed: Oct. 15, 2013

(65) Prior Publication Data

US 2014/0034425 A1 Feb. 6, 2014

Related U.S. Application Data

(63) Continuation of application No. PCT/FI2012/050450, filed on May 9, 2012.

(30) Foreign Application Priority Data

May 18, 2011 (FI) ..... 20115479

(51) Int. Cl.
*B66B 11/08* (2006.01)
*B66B 19/00* (2006.01)
(Continued)

(52) U.S. Cl.
CPC ..... *B66B 11/008* (2013.01); *B66B 9/00* (2013.01); *B66B 11/009* (2013.01); *B66B 11/0045* (2013.01); *B66B 19/007* (2013.01)

(58) Field of Classification Search
CPC ..... B66B 11/009; B66B 11/08; B66B 11/008; B66B 11/0045; B66B 7/062
(Continued)

(56) References Cited

U.S. PATENT DOCUMENTS 12,640 A * 4/1855 Murtaugh ..... B66B 11/0415 174/81
657,380 A * 9/1900 Baldwin ..... B66B 11/009 187/265
(Continued)

FOREIGN PATENT DOCUMENTS

CN 1212948 A 4/1999
CN 1233583 A 11/1999
(Continued)

OTHER PUBLICATIONS

Extended European Search Report issued in corresponding EP Application No. 12786417, dated Sep. 4, 2014.
(Continued)

*Primary Examiner* — William A Rivera
*Assistant Examiner* — Stefan Kruer
(74) *Attorney, Agent, or Firm* — Harness, Dickey & Pierce, PLC

(57) ABSTRACT

The object of the invention is an elevator arrangement, which comprises at least an elevator car configured to move up and down in an elevator hoistway and at least two compensating weights, which are for their part connected to support the elevator car by the aid of their own support means, such as by the aid of ropes or belts and also e.g. diverting pulleys, and a hoisting machine provided with at
(Continued)

Figure 1:
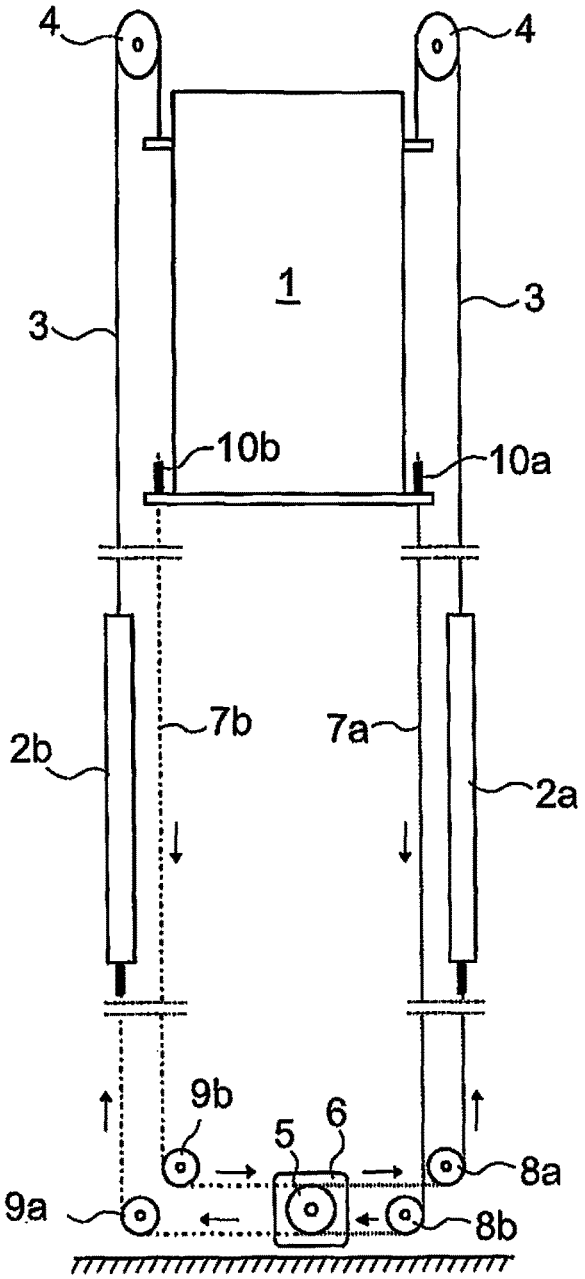

least one traction sheave or corresponding, and at least one traction means such as a rope or belt, which is configured to transmit the rotational movement of the traction sheave into movement of the elevator car and of the compensating weights. Each compensating weight is connected by the aid of a traction means to the same hoisting machine.

19 Claims, 9 Drawing Sheets

(51) Int. Cl.
*B66B 7/06* (2006.01)
*B66B 11/00* (2006.01)
*B66B 9/00* (2006.01)

(58) Field of Classification Search
USPC ..... 187/404, 264, 266
See application file for complete search history.

(56) References Cited

U.S. PATENT DOCUMENTS

| | | | | | |
|---|---|---|---|---|---|
| 684,390 | A * | 10/1901 | Venn | B66B 11/009 | 187/260 |
| 735,093 | A * | 8/1903 | Greenwald | B66B 17/12 | 187/404 |
| 811,513 | A * | 1/1906 | MacKaye | B66B 11/009 | 187/264 |
| 987,384 | A * | 3/1911 | Lindquist | B66B 11/009 | 187/264 |
| 1,051,335 | A | 1/1913 | King | | |
| 1,132,769 | A * | 3/1915 | Gale | B66B 11/009 | 187/264 |
| 1,566,385 | A * | 12/1925 | Dunn | B66B 1/3469 | 187/254 |
| 1,702,783 | A | 2/1929 | Kiesling | | |
| 3,174,585 | A | 3/1965 | Tofanelli | | |
| 3,845,842 | A | 11/1974 | Johnson | | |
| 5,379,863 | A * | 1/1995 | Sugawara | B66F 9/07 | 187/233 |
| 5,566,783 | A | 10/1996 | Yamashita | | |
| 5,699,879 | A | 12/1997 | Sakita | | |
| 6,305,499 | B1 | 10/2001 | Jones et al. | | |
| 6,364,063 | B1 | 4/2002 | Aulanko et al. | | |
| 6,386,324 | B1 | 5/2002 | Baranda et al. | | |
| 6,390,242 | B1 | 5/2002 | Baranda et al. | | |
| 6,481,538 | B2 | 11/2002 | Blackaby et al. | | |
| 6,491,136 | B2 | 12/2002 | Kobayashi et al. | | |
| 6,739,433 | B1 | 5/2004 | Baranda et al. | | |
| 6,848,543 | B2 | 2/2005 | Adifon et al. | | |
| 6,851,519 | B2 * | 2/2005 | Ach | B66B 11/008 | 187/254 |
| 6,860,367 | B1 * | 3/2005 | Ericson | B66B 11/008 | 187/251 |
| 7,299,896 | B1 | 11/2007 | Adifon et al. | | |
| 7,367,430 | B2 * | 5/2008 | Ach | B66B 7/062 | 187/254 |
| 7,717,237 | B2 | 5/2010 | Zamorano Morfin | | |
| 8,157,058 | B2 | 4/2012 | Ach | | |
| 2002/0000346 | A1 | 1/2002 | Baranda et al. | | |
| 2002/0000347 | A1 | 1/2002 | Baranda et al. | | |
| 2004/0206579 | A1 | 10/2004 | Baranda et al. | | |
| 2007/0246303 | A1 | 10/2007 | Zamorano Morfin | | |
| 2009/0107776 | A1 | 4/2009 | Baranda et al. | | |
| 2014/0034425 | A1 * | 2/2014 | Rasanen | B66B 9/00 | 187/256 |
| 2014/0083802 | A1 * | 3/2014 | Aulanko | B66B 7/10 | 187/265 |

FOREIGN PATENT DOCUMENTS

| | | | | |
|---|---|---|---|---|
| CN | 1257821 | A | 6/2000 | |
| CN | 1342130 | A | 3/2002 | |
| CN | 1356256 | A | 7/2002 | |
| CN | 1475427 | A | 2/2004 | |
| CN | 1705612 | A | 12/2005 | |
| CN | 101041407 | A | 9/2007 | |
| CN | 201400508 | Y | 2/2010 | |
| CN | 101903278 | A | 12/2010 | |
| DE | 1506479 | A1 | 12/1969 | |
| DE | 102006037253 | | 2/2008 | |
| EP | 0905081 | A2 | 3/1999 | |
| EP | 1493708 | A2 | 1/2005 | |
| EP | 1760028 | A1 | 3/2007 | |
| EP | 1097101 | B1 | 5/2007 | |
| EP | 1801061 | A1 | 6/2007 | |
| ES | 2161183 | A1 | 11/2001 | |
| FI | WO 9829326 | A1 * | 7/1998 | B66B 11/009 |
| FR | 1397440 | A | 4/1965 | |
| FR | 2813874 | A1 | 3/2002 | |
| FR | 2823734 | A1 | 10/2002 | |
| JP | 52057644 | A * | 5/1977 | |
| JP | 09-328270 | | 12/1997 | |
| JP | 2004001912 | A | 1/2004 | |
| JP | 2005206263 | A | 8/2005 | |
| JP | WO 2007135716 | A1 * | 11/2007 | B66B 11/005 |
| JP | 2010-149968 | A | 7/2010 | |
| JP | 4558336 | B2 | 10/2010 | |
| WO | WO-9829327 | A1 | 7/1998 | |
| WO | WO-9943599 | A1 | 9/1999 | |
| WO | WO-9943600 | A1 | 9/1999 | |
| WO | WO 9943601 | A2 * | 9/1999 | B66B 9/027 |
| WO | WO-03043927 | A2 | 5/2003 | |

OTHER PUBLICATIONS

International Search Report PCT/ISA/210 for PCT/FI2012/050809 dated Nov. 16, 2012.
Written Opinion PCT/ISA/237 for PCT/FI2012/050809 dated Nov. 16, 2012.
Finnish Search Report for Finnish Application No. 20115902 dated Jun. 28, 2012.
Chinese Office Action issued in Chinese Patent Application No. 201280024140, dated Jan. 5, 2016.
Extended European Search Report issued in EP Application No. 12832049.6, dated Apr. 9, 2015.
U.S. Office Action issued in U.S. Appl. No. 14/193,444, mailed May 19, 2016.
U.S. Office Action issued in U.S. Appl. No. 14/193,444, mailed Jan. 25, 2016.
International Search Report PCT/ISA/210 for PCT/FI2012/050450 dated Aug. 30, 2012.
Finnish Search Report for PCT/FI2012/050450 dated Feb. 27, 2012.
Written Opinion PCT/ISA/237 for PCT/FI2012/050450 dated Aug. 30, 2012.

* cited by examiner

ELEVATOR ARRANGEMENT

This application is a continuation of PCT International Application No. PCT/FI2012/050450 which has an International filing date of May 9, 2012, and which claims priority to Finnish patent application number 20115479 filed May 18, 2011, the entire contents of both which are incorporated herein by reference.

The object of the invention is an elevator arrangement.

The solution according to the invention is well suited to low-rise and medium-rise buildings and even to extremely tall buildings in which one problem is that when the hoisting machine of the elevator is above, installation of the machine and peripheral structures is awkward, expensive and even dangerous. Additionally, the high-speed elevators in high-rise buildings require large fuses and there are often many elevators in one or more elevator groups. For this reason also the electric cabling needed for the elevator hoisting machines are expensive and in high-rise buildings this is even more pronounced because the electric cables from the power distribution boards below to the hoisting machines above are long. Long electric cables cause power losses and various interferences in their immediate environment, e.g. electromagnetic interferences. The solution according to the invention is also suited for a new elevator in low-rise buildings that previously had no elevator. In addition, the solution according to the invention is well suited to the modernization of old elevators.

Figure 8:
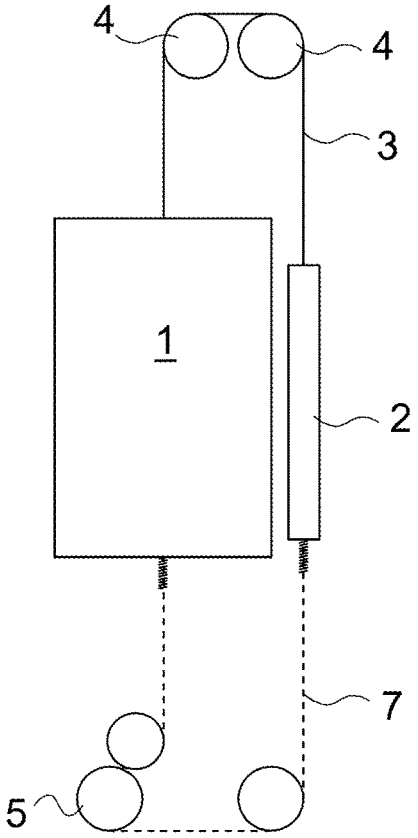
Figure 9:
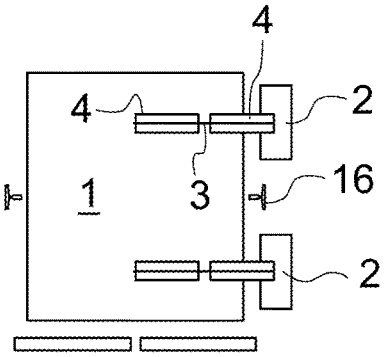

Elevator solutions wherein the hoisting machine of the elevator is disposed on the base of the elevator hoistway, or close to the bottom part of the elevator hoistway, are known in the art. When the hoisting machine is disposed thus, the supporting ropes of the elevator cannot generally function simultaneously as the means intended for moving the elevator car, but instead separate traction ropes or traction belts are needed for the moving. One such prior-art solution is presented in international patent publication no. WO03/043927 A2, in which FIGS. 8 and 9 present solutions wherein the hoisting machine of an elevator is in the bottom part of the hoistway and the supporting ropes of the elevator car and the traction ropes are different ropes. The elevator car and the counterweight are supported by the aid of a diverting pulley above, over which the supporting ropes fixed to the elevator car and to the counterweight pass. Correspondingly, the moving of the elevator car is implemented with a separate toothed belt, which passes around the traction sheave of a hoisting machine below and is fixed from below between the elevator car and the counterweight. A problem in this solution is at least that the solution is difficult to alter in relation to the layout. One large counterweight takes space to such an extent that flexible layouts cannot easily be used.

Patent publications EP1097101 B1, EP1493708 A2, FR2813874 A1 and FR2823734 A1 also present corresponding elevator solutions, wherein the hoisting machine of an elevator is on the base of the hoistway, or close to it, and the supporting ropes of the elevator car and the traction ropes are separate. In all these solutions, however, there is only one large counterweight, the drawbacks of which solution have been explained in the preceding.

US patent publication no. US2007246303 A1 presents an elevator solution, some embodiments in which comprise two counterweights. This solution, however, differs from conventional elevator solutions in that the elevator car is supported and moved with chains and sprocket wheels and there are numerous hoisting motors; at least one hoisting motor per counterweight. Thus the solution is complex and prone to defects, and also precise synchronization of the speed between different hoisting motors is awkward. Likewise, for structural reasons the use of two counterweights does not here bestow any advantage in respect of better flexibility of layout designs.

The aim of the present invention is to eliminate the aforementioned drawbacks and to achieve an inexpensive and easy-to-implement elevator arrangement, which combines the advantages of a hoisting machine disposed in the bottom part of the elevator hoistway and of flexible layout design. Additionally, the aim of the invention is to achieve an arrangement, which enables a number of different, easy-to-implement suspension options for an elevator with machine room below. Likewise, one aim is to achieve an elevator arrangement, which can be implemented with essentially the same type of elevator for different purposes, such as for residential apartment use, hotel use or some other commercial property use, and in which the balance of the elevator can be optimized in relation to energy consumption according to the amount and the nature of the elevator traffic.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can, in at least some situations, be deemed to be inventive in their own right.

One advantage, among others, of the solution according to the invention is that by means of it machine room space is saved. Another advantage is also that the solution according to the invention is space-efficient in the width direction, depth direction and also the height direction of the elevator hoistway. In the height direction, this enables the diverting pulleys in the top part of the elevator hoistway to be disposed outside the projection of the car such that the top edge of the elevator car in its upper position can drive between the diverting pulleys or even past the diverting pulleys to above them. In this case the smallest possible top clearance that can be utilized well is obtained. Yet another advantage is that by means of the arrangement according to the invention the rope arrangements and layouts of elevators can be diversified, which enables easier layout design.

Another advantage is that installation of a hoisting machine is easier and cheaper than when installing the hoisting machine into the top part of a building. Likewise the structures and peripherals of the elevator are in this case lighter and cheaper. Yet another advantage is that the same elevator concept can be used for different applications, e.g. for residential apartment use, hotel use or some other commercial property use, and the use of the elevator can be monitored after the original installation and, based on the results, the balance of the elevator can easily be changed to correspond better to the actual use of the elevator. Yet another advantage is faster and easier installation of an elevator.

The separation of the support means and the traction means enables their optimization for their purpose of use in terms of their dimensioning, method of use and properties. For example, now it is not necessary to take into account the durability to such a high surface pressure in the ropes preferably used as support means as if these ropes were driven by the aid of a traction sheave provided with undercut rope grooves.

The fact that the diverting pulleys in the top part of the elevator hoistway are disposed outside the projection of the car, such that the top edge of the elevator car in its upper position can drive between the diverting pulleys or even past the diverting pulleys to above them, is one aspect of the invention. This aspect, on its own or together with one or more attributes of an inventive feature presented in this application, defines the preferred inventive elevator solutions. A particularly advantageous solution from the viewpoint of this aspect, especially from the standpoint of space usage, is brought about by placing all the diverting pulleys and traction sheaves of an elevator otherwise than directly below or directly above the elevator car, in which case also both the support means supporting the elevator car and the compensating weight(s) as well as the traction means connecting the elevator car and the compensating weight(s) can be guided suitably on the side of the trajectory of the elevator car.

The aspect of the invention wherein the diverting pulleys in the top part of the elevator hoistway are disposed outside the projection of the car such that the top edge of the elevator car in its upper position can drive between the diverting pulleys or even past the diverting pulleys to above them, can be implemented also by overlapping the structures of the elevator car and the diverting pulleys and traction sheaves guiding the support means and the traction means such that the support means supporting the elevator car and the compensating weight(s) as well as the traction means connecting the elevator car and the compensating weight(s) are guided on the side of the trajectory of the elevator car.

In this presentation the invention is described a great deal as an elevator arrangement but the invention is also manifested as an elevator that comprises at least an elevator car to be moved in an elevator hoistway and one or more compensating weights and a hoisting machine moving via traction means the support means supporting said elevator car and compensating weights, the traction means connecting the elevator car and each compensating weight, the elevator car and the compensating weights. The invention is also manifested as an installation method or installation methods described in this presentation, in which case the elevator car is used as an aid for installation of the guide rails.

Figure 1A:
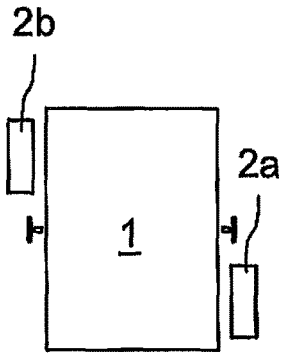
Figure 1B:
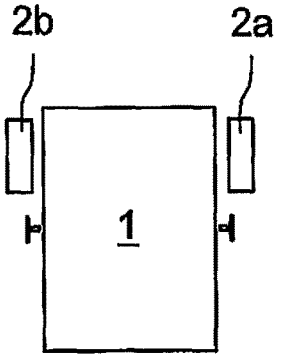
Figure 2:
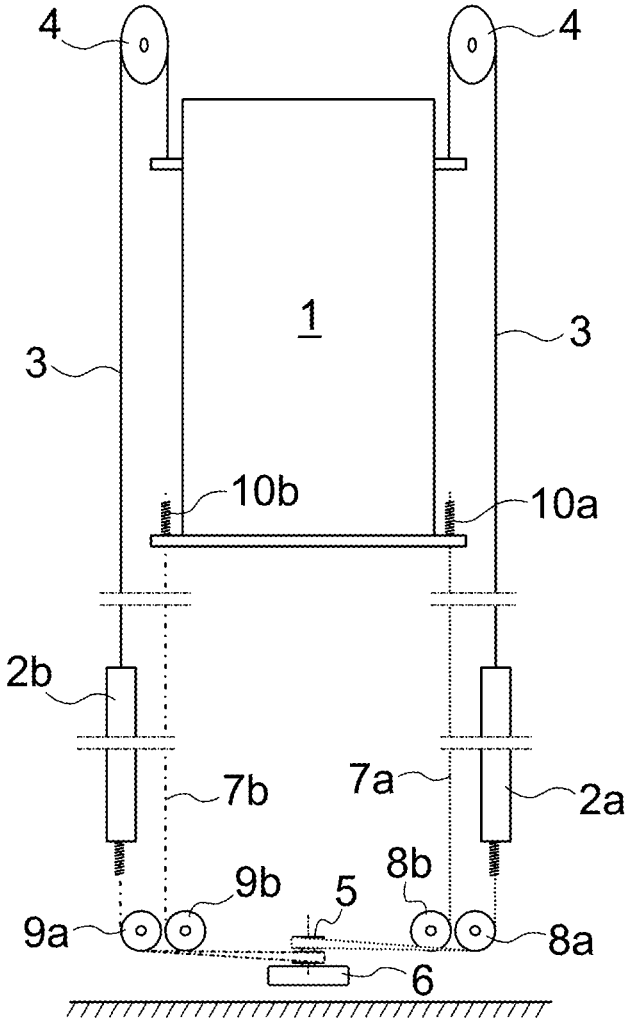
Figure 3:
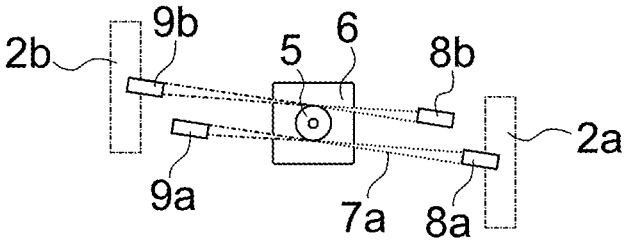
Figure 4:
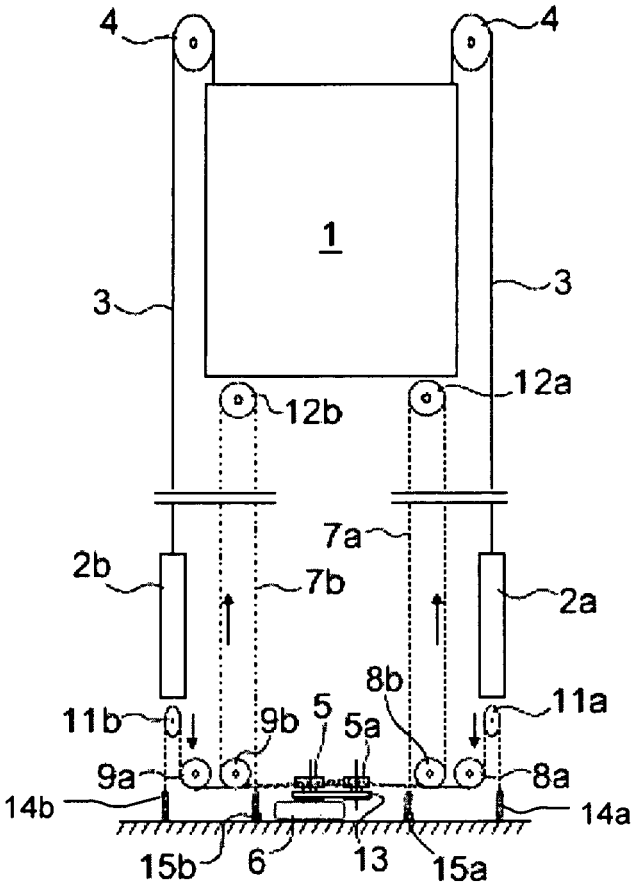
Figure 5:
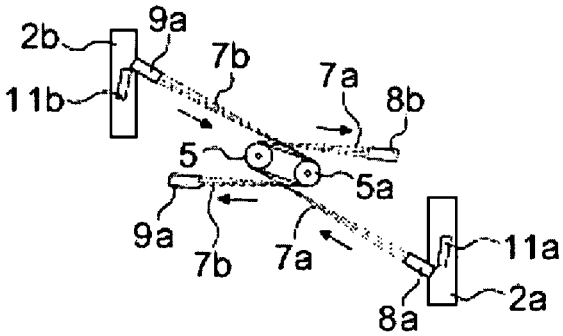
Figure 6:
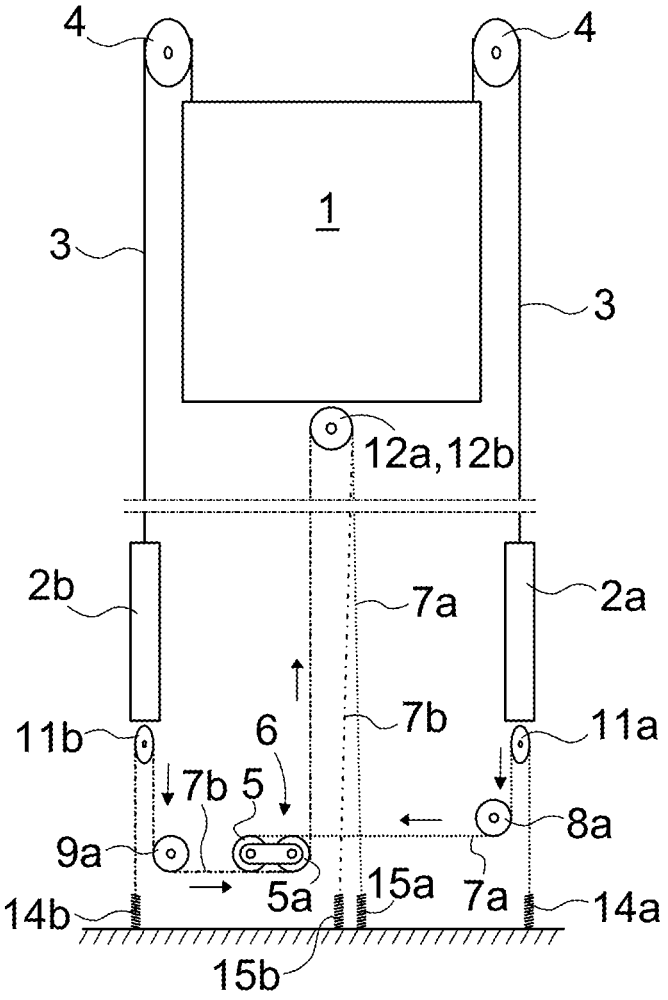
Figure 7:
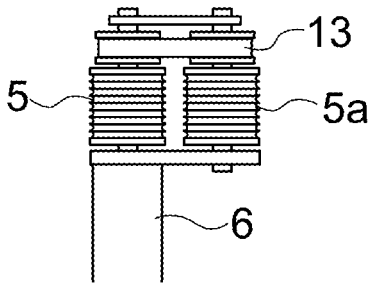
Figure 7A:
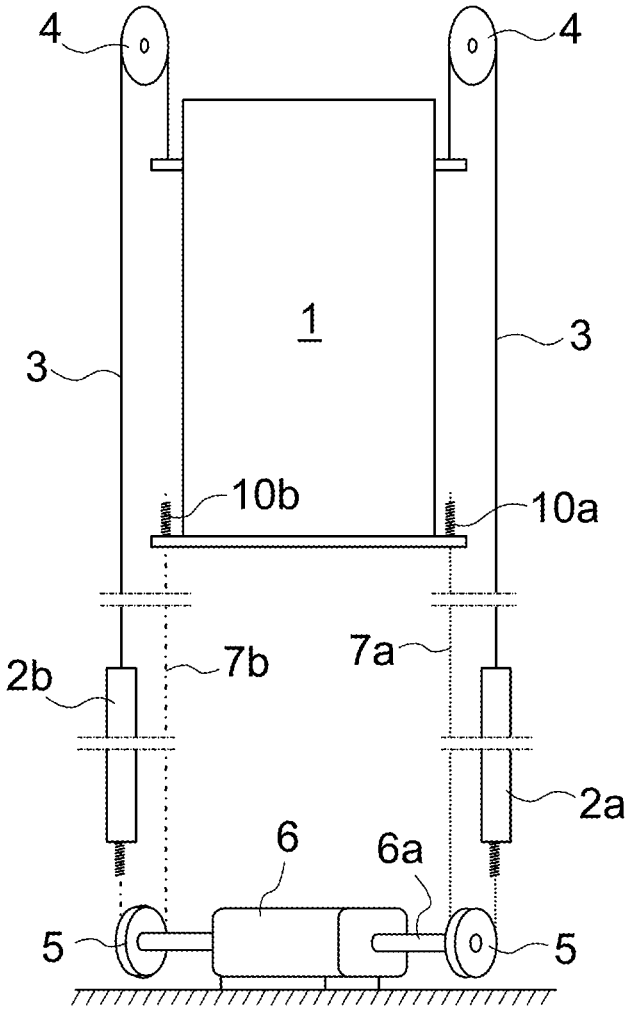
Figure 7B:
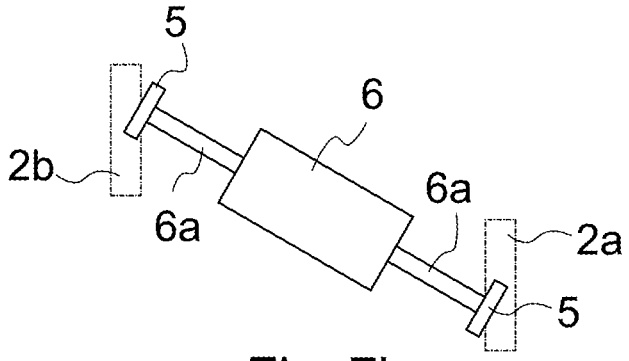
Figure 10:
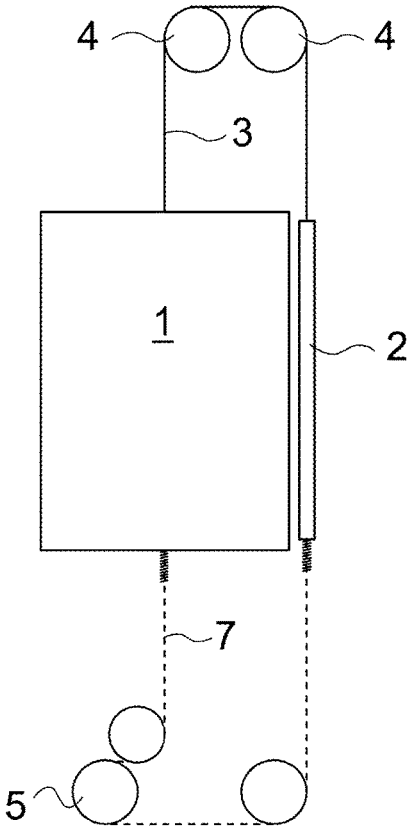
Figure 11:
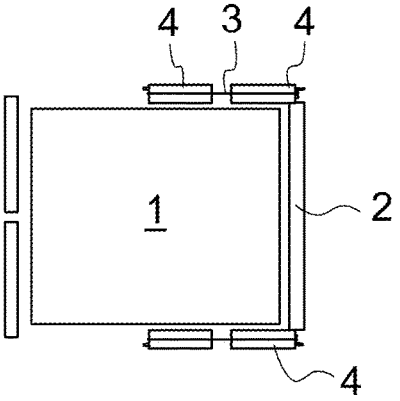
Figure 12:
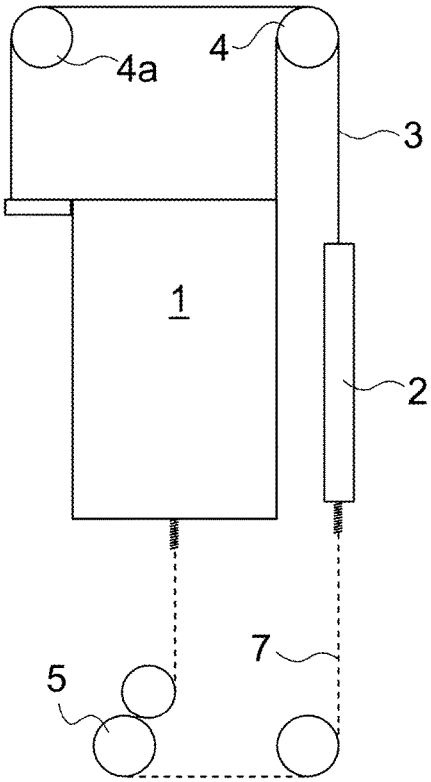
Figure 14:
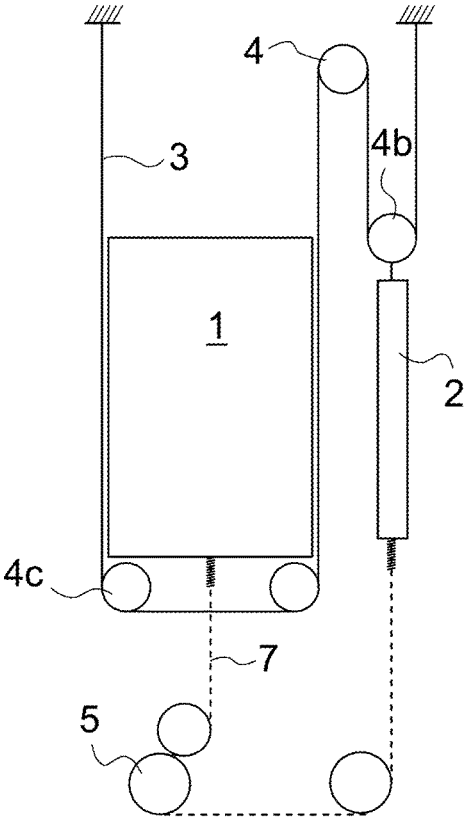
Figure 13:
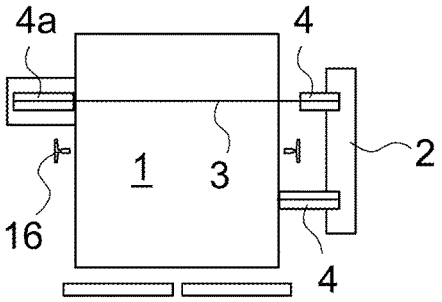
Figure 15:
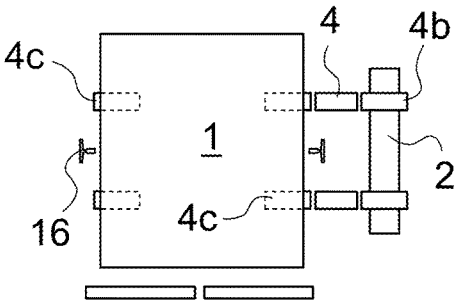
Figure 16:
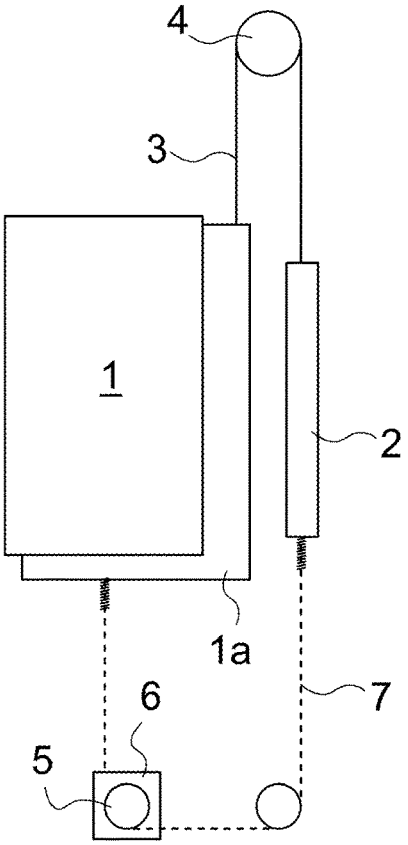
Figure 18:
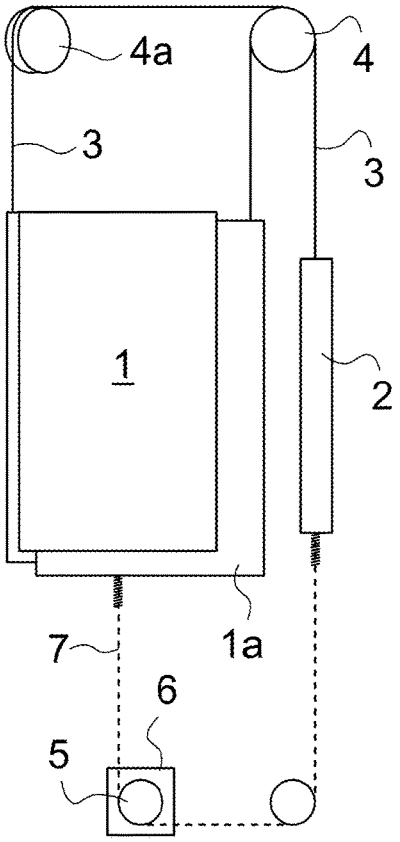
Figure 17:
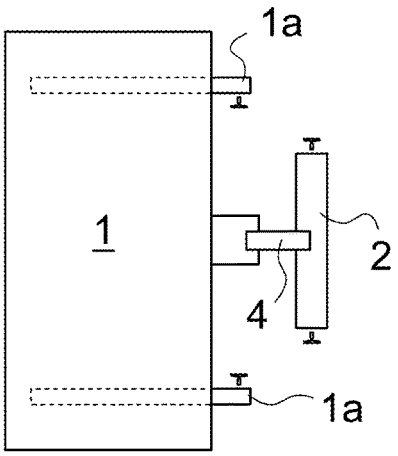
Figure 19:
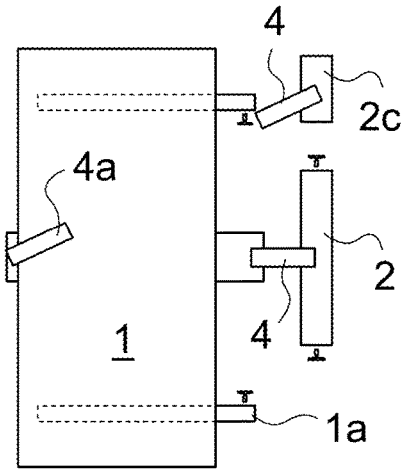
Figure 20:
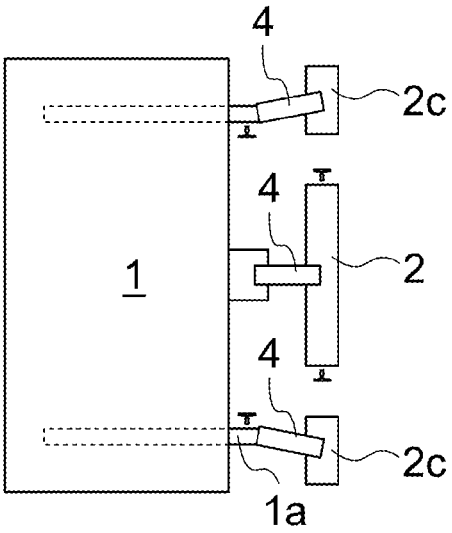
Figure 21:
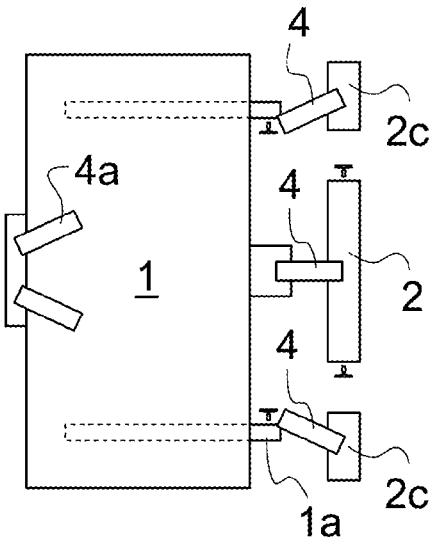
Figure 22:
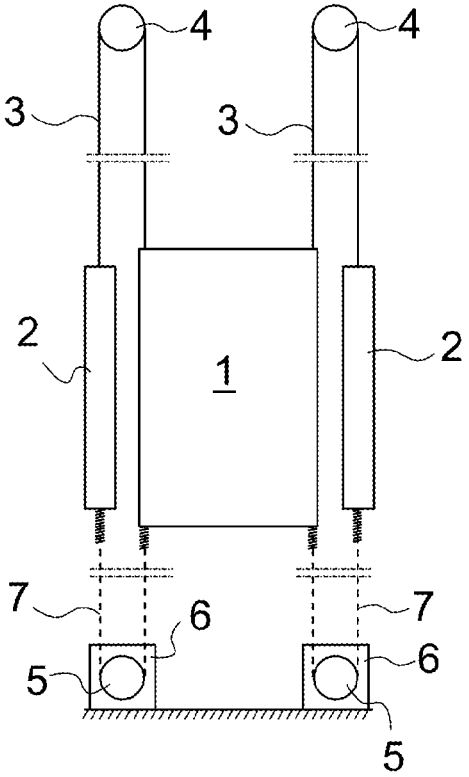
Figure 23:
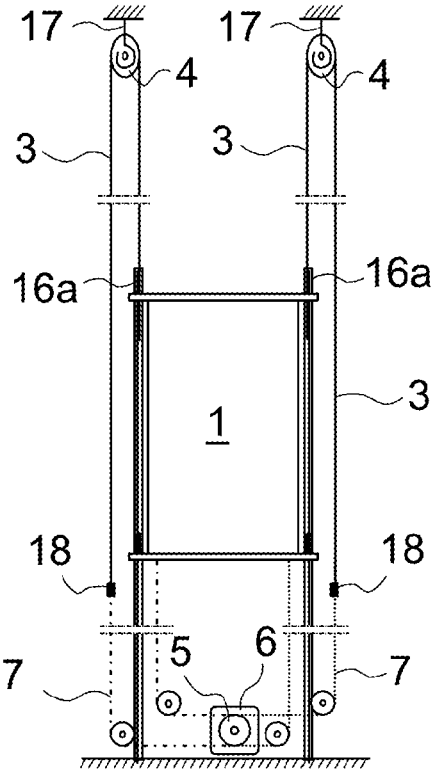

In the following, the invention will be described in more detail by the aid of some examples of its embodiment with reference to the simplified and diagrammatic drawings attached, wherein FIG. 1 presents a simplified and diagrammatic side view of one elevator arrangement according to the invention, wherein the hoisting machine of the elevator is disposed in the bottom part of the elevator hoistway, or close to it, FIG. 1*a* presents a simplified and diagrammatic top view of one elevator arrangement according to FIG. 1, wherein the compensating weights are disposed on different sides of the guide rail line of the elevator car to each other and on different sides of the elevator car, FIG. 1*b* presents a simplified and diagrammatic top view of one elevator arrangement according to FIG. 1, wherein the compensating weights are disposed on the same side of the guide rail line of the elevator car as each other and on different sides of the elevator car, FIG. 2 presents a simplified and diagrammatic side view of one second elevator arrangement according to the invention, wherein the hoisting machine of the elevator is disposed in the bottom part of the elevator hoistway, or close to it, FIG. 3 presents a simplified top view of an elevator arrangement according to FIG. 2, in the bottom part of the elevator hoistway, FIG. 4 presents a simplified and diagrammatic side view of one third elevator arrangement according to the invention, wherein the hoisting machine of the elevator is disposed in the bottom part of the elevator hoistway, or close to it, FIG. 5 presents a simplified top view of an elevator arrangement according to FIG. 4, in the bottom part of the elevator hoistway, FIG. 6 presents a simplified and diagrammatic side view of one more elevator arrangement according to the invention, wherein the hoisting machine of the elevator is disposed in the bottom part of the elevator hoistway, or close to it, FIG. 7 presents a simplified top view of an elevator machine according to FIG. 6, in the bottom part of the elevator hoistway, FIG. 7*a* presents a simplified and diagrammatic side view of one more elevator arrangement according to the invention, wherein the hoisting machine of the elevator is disposed in the bottom part of the elevator hoistway, or close to it, FIG. 7*b* presents a simplified top view of an elevator arrangement according to FIG. 7*a*, in the bottom part of the elevator hoistway, FIG. 8 presents a simplified and diagrammatic front view of one elevator arrangement according to the invention, wherein the hoisting machine of the elevator is disposed in the bottom part of the elevator hoistway, or close to it, FIG. 9 presents a simplified top view of an elevator arrangement according to FIG. 8, FIG. 10 presents a simplified and diagrammatic side view of one more elevator arrangement according to the invention, wherein the hoisting machine of the elevator is disposed in the bottom part of the elevator hoistway, or close to it, FIG. 11 presents a simplified top view of an elevator arrangement according to FIG. 10, FIG. 12 presents a simplified and diagrammatic front view of yet one more elevator arrangement according to the invention, wherein the hoisting machine of the elevator is disposed in the bottom part of the elevator hoistway, or close to it, FIG. 13 presents a simplified top view of an elevator machine according to FIG. 12, FIG. 14 presents a simplified and diagrammatic front view of one elevator arrangement according to the invention, wherein the elevator car is supported with 2:1 suspension, and wherein the hoisting machine of the elevator is disposed in the bottom part of the elevator hoistway, or close to it, FIG. 15 presents a simplified top view of an elevator arrangement according to FIG. 14, FIG. 16 presents a simplified and diagrammatic side view of one elevator arrangement according to the invention, wherein a so-called "rucksack elevator" is modernized, and wherein the hoisting machine of the elevator is disposed in the bottom part of the elevator hoistway, or close to it, FIG. 17 presents a simplified top view of an elevator machine according to FIG. 16, FIG. 18 presents a simplified and diagrammatic side view of one second elevator arrangement according to the invention, wherein a so-called "rucksack elevator" is modernized, and wherein the hoisting machine of the elevator is disposed in the bottom part of the elevator hoistway, or close to it, and FIG. 19 presents a simplified top view of an elevator machine according to FIG. 18, FIG. 20 presents a simplified and diagrammatic top view of one elevator arrangement according to the invention, wherein a so-called "rucksack elevator" is modernized, and wherein the hoisting machine of the elevator is disposed in the bottom part of the elevator hoistway, or close to it, FIG. 21 presents a simplified and diagrammatic top view of one more elevator arrangement according to the invention, wherein a so-called "rucksack elevator" is modernized, and wherein the hoisting machine of the elevator is disposed in the bottom part of the elevator hoistway, or close to it, FIG. 22 presents a simplified and diagrammatic front view of yet one more elevator arrangement according to the invention, wherein two hoisting machines of the elevator are disposed in the bottom part of the elevator hoistway, or close to it, and FIG. 23 presents a simplified and diagrammatic front view of one elevator arrangement according to the invention in the installation phase.

One elevator arrangement according to the invention comprises at least an elevator car 1 configured to move up and down in an elevator hoistway and at least two compensating weights 2*a*, 2*b*, which are for their part connected to support the elevator car 1 by the aid of their own support means 3, such as by the aid of ropes or belts and also by the aid of e.g. diverting pulleys 4 mounted on bearings on the top part of the elevator hoistway. In addition, the elevator arrangement comprises a hoisting machine 6 provided with at least one traction sheave 5 or corresponding, and at least two or more traction means 7*a*, 7*b*, such as a rope or a belt, which are configured to transmit the rotational movement of the traction sheave 5 into linear movement of the elevator car 1 and of the compensating weights 2*a*, 2*b*. Characteristic to the invention, and common to all the different embodiments of the invention, is that each compensating weight 2*a*, 2*b*, or in some cases only one, or more than two, compensating weights, are connected by the aid of their own traction means 7*a*, 7*b* to one and the same hoisting machine 6. If there is only one compensating weight, for safety reasons there are nevertheless at least two traction means so that when one traction means loses its grip, the other one still grips and the elevator car is not able to rush to the roof with a small load pulled by the compensating weight.

The aforementioned two or more compensating weights 2*a*, 2*b* enable an essentially easy layout in elevator design. At the same time the layout also brings various space benefits. In this case one layout solution can be e.g. the type of layout in which, when viewed from above, at the center of the elevator hoistway is a plane formed by the car guide rails of the elevator and around this plane are four corners for different structural solutions. For example, two corners are used for the compensating weights 2*a*, 2*b* and their guide rails, one corner is used for safety devices, mainly e.g. for an overspeed governor, and one corner is used for other devices, such as for the trailing cables, et cetera. From the viewpoint of the layout, it is advantageous to situate the compensating weights 2*a*, 2*b*, with their guide rails, in the rear corners of the elevator hoistway.

FIG. 1 presents a simplified and diagrammatic side view of one elevator arrangement according to the invention. The elevator arrangement according to FIG. 1 comprises two compensating weights 2*a* and 2*b*, both of which are connected to the elevator car 1 by the aid of their own support means 3. Each support means 3 is fixed at its first end to the elevator car 1 and passes over the diverting pulley 4 in the top part of the elevator hoistway or in the machine room and returns downwards, and is fixed at its second end to a compensating weight 2*a*, 2*b*. The fixing point of the first end of the support means 3 to the elevator car 1 is configured such that the elevator car 1 can rise past the diverting pulleys 4 in the top end of the hoistway right to the top end of the hoistway. In this way the most space-efficient layout solution possible is achieved. All the elevator arrangements according to the invention can comprise the same type of fixing solution of the support means 3 to the elevator car 1, although that is not presented in all the figures.

A hoisting machine 6 provided with a traction sheave 5 is configured to move the elevator car, which hoisting machine is preferably disposed in the bottom part of the elevator hoistway, e.g. on the base of the elevator hoistway or right in the proximity of the base. In this case installation of the hoisting machine 6 is easy, and long electric cables from the bottom part of the building to the hoisting machine or to the cubicles are not needed. Additionally, at least one humidity sensor, which is arranged to issue an alarm and if necessary to stop the elevator if excessive water comes onto the base of the hoistway, is disposed on the base of the hoistway. In this way the elevator machine and the electrical components of the elevator can be protected from excessive humidity.

For each compensating weight separately its own traction means 7*a*, 7*b* is disposed between the bottom part of the compensating weights 2*a*, 2*b* and the bottom part of the elevator car 1, which traction means receives its movement transmission force from the traction sheave 5 of the hoisting machine 6.

The first traction means 7*a* is fixed at its first end to a first compensating weight 2*a*, is configured to leave the compensating weight 2*a* and go downwards and is led to pass under at least one diverting pulley 8*a*, after which the traction means 7*a* is led to a traction sheave 5, which rotates on the vertical plane, of a hoisting machine 6 disposed below the elevator car 1 from the first side of the traction sheave 5, and is configured to pass around the traction sheave 5 on a first point of the contact surface of the traction sheave 5 on the second side of the traction sheave 5, to return back to the first side of the traction sheave 5 and is led onwards to pass under at least a second diverting pulley 8*b* and to ascend after this to the elevator car 1, to the fixing point 10*a* on which elevator car the traction means 7*a* is fixed at its second end.

The second traction means 7*b* is configured to travel from the second compensating weight 2*b* via the traction sheave 5 to the elevator car in essentially the same manner as the first traction means 7*a*. In this case the second traction means 7*b* is fixed at its first end to a second compensating weight 2*b*, is configured to leave the compensating weight 2*b* and go downwards and is led to pass under at least one diverting pulley 9*a*, after which the traction means 7*b* is led to a traction sheave 5, which rotates on the vertical plane, of the hoisting machine 6 disposed below the elevator car 1 from the second side of the traction sheave 5, and is configured to pass around the traction sheave 5 on a second point of the contact surface of the traction sheave 5 on the first side of the traction sheave 5, to return back to the second side of the traction sheave 5 and is led onwards to pass under at least a second diverting pulley 9*b* and to ascend after this to the elevator car 1, to the fixing point 10*b* on which elevator car the traction means 7*b* is fixed at its second end.

The contact surface of the traction sheave 5 is so wide that both the traction means 7*a*, 7*b* fit side-by-side onto the contact surface of the traction sheave without interfering with each other. In this way one and the same hoisting machine 6 gives to both the traction means 7*a*, 7*b* a force producing linear movement of the elevator car 1 and of the compensating weights 2*a*, 2*b*.

FIGS. 1*a* and 1*b* present top views of different options for disposing the compensating weights 2*a*, 2*b* in the elevator hoistway. In FIG. 1*a* the compensating weights 2*a*, 2*b* are disposed on opposite sides of the elevator car 1 and on different sides of the guide rail line of the elevator car 1 to each other, in which case the suspension of the elevator car 1 and of the compensating weights 2*a*, 2*b* is very symmetrical and does not produce any additional stresses e.g. on the guide rails. This is an extremely advantageous layout option if it is only possible. Correspondingly, in FIG. 1*b* the compensating weights 2*a*, 2*b* are disposed on opposite sides of the elevator car 1 and on the same side of the guide rail line of the elevator car 1 as each other. In this case the reason has been e.g. some issue relating to layout, owing to which the space on the other side of the guide rail has been reserved for some other use than the use of compensating weights. In this solution also, however, it is possible to implement suspension that is as symmetrical as possible and that does not additional stresses e.g. on the guide rails.

FIGS. 2 and 3 present a simplified and diagrammatic view of one second elevator arrangement according to the invention, wherein the hoisting machine 6 of the elevator is disposed in the bottom part of the elevator hoistway, or close to it. FIG. 2 presents the solution as viewed from the side, and FIG. 3 the same solution as viewed from the top of the hoisting machine 6. For the sake of clarity the compensating weights 2*a*, 2*b* are presented in FIG. 3 with dot-and-dash lines.

In the arrangement according to FIGS. 2 and 3 the traction means 7*a* and 7*b* are led to circulate from the compensating weights 2*a* and 2*b* to the elevator car in essentially the same manner as in the arrangement according to FIG. 1. The difference now, however, is that the hoisting machine 6 has been turned into such an attitude that the shaft of it is essentially vertical, in which case the plane of rotation of the traction sheave 5 is essentially on the horizontal plane. In this way a very shallow machine solution is achieved, which reduces the space requirement in the bottom part of the hoistway and enables driving of the elevator car to as far down as possible. The contact surface of the traction sheave 5 is, however, so wide that both the traction means 7*a*, 7*b* fit side-by-side onto the contact surface of the traction sheave without interfering with each other.

FIGS. 4 and 5 present a simplified and diagrammatic view of one third elevator arrangement according to the invention, wherein the hoisting machine 6 of the elevator is disposed in the bottom part of the elevator hoistway, or close to it. FIG. 4 presents the solution as viewed from the side, and FIG. 5 the same solution as viewed from the top of the hoisting machine 6. For the sake of clarity the compensating weights 2*a*, 2*b* are presented in FIG. 5 with dot-and-dash lines.

Each traction means 7*a*, 7*b*, in this embodiment e.g. a plurality of elevator ropes, connecting the elevator car 1 and the compensating weights 2*a*, 2*b* is fixed at its first end to an essentially immobile fixing point 14*a*, 14*b* that is below the elevator car 1 and that is provided with a prestressing element, such as a spring, from where both the traction means 7*a*, 7*b* are led to the diverting pulley 11*a*, 11*b* that is in connection with the compensating weight 2*a*, 2*b*, after passing over which diverting pulley both traction means 7*a*, 7*b* are led downwards to pass under the diverting pulley 8*a*, 9*a* that is below the elevator car 1 and onwards around the two traction sheaves 5, 5*a*, belonging to the hoisting machine 6, that are in synchrony with each other and rotating around a vertical axis, forming a so-called Extended Double Wrap loop.

In this case the first traction means 7*a* is led initially to the first traction sheave 5, after passing around which the first traction means 7*a* is led to a second traction sheave 5*a* and onwards after passing around the second traction sheave 5*a* again to the first traction sheave 5, after passing around which the traction means 7*a* is led to pass under a diverting pulley 8*b* below the elevator car 1 onwards up to a diverting pulley 12*a* in connection with the elevator car 1, after passing around the top of which onwards to its essentially immobile fixing point 15*a* below the elevator car 1, to which fixing point the second end of the traction means 7*a* is fixed.

Correspondingly in this case, the second traction means 7*b* is led initially to the second traction sheave 5*a*, after passing around which the second traction means 7*b* is led to the first traction sheave 5 and onwards after passing around the first traction sheave 5 again to the second traction sheave 5*a*, after passing around which the traction means 7*b* is led to pass under a diverting pulley 9*b* below the elevator car 1 onwards up to a diverting pulley 12*b* in connection with the elevator car 1, after passing around the top of which diverting pulley onwards to its essentially immobile fixing point 15*b* below the elevator car 1, to which fixing point the second end of the traction means 7*b* is fixed.

The first traction sheave 5 is fixed directly to the shaft of the hoisting machine 6, and the second traction sheave 5*a* is mounted on bearings allowing free rotation. The traction sheaves 5 and 5*a* are further connected to each other via a cogged belt 13, which synchronizes the speeds of rotation of the traction sheaves 5, 5*a* so that they are the same. With this solution an overall contact angle e.g. between the traction means 7*a*, 7*b* and the traction sheaves 5 and 5*b* of approx. 340° is achieved, in which the first angle of contact is approx. 160° and the second angle of contact is approx. 180°. Formed thus, the solution enables good frictional grip for the elevator ropes used as the traction means 7*a*, 7*b*.

FIGS. 6 and 7 present a simplified and diagrammatic view of one more elevator arrangement according to the invention, wherein the hoisting machine 6 of the elevator is disposed in the bottom part of the elevator hoistway, or close to it. FIG. 6 presents the solution as viewed from the side, and FIG. 7 the same solution partially sectioned and as viewed from the top of the hoisting machine 6.

In the arrangement according to FIGS. 6 and 7 the first traction means 7*a* is fixed at its first end to an essentially immobile fixing point 14*a* that is below the elevator car 1 and that is provided with a prestressing element, such as a spring, from where the traction means 7*a* is led to the diverting pulley 11*a* that is in connection with the compensating weight 2*a*, after passing over which diverting pulley the traction means 7*a* is led downwards to pass under the diverting pulley 8*a* that is below the elevator car 1 and onwards around the top of a first traction sheave 5 belonging to the hoisting machine 6, after which the first traction means 7*a* is led to pass around the bottom of a second traction sheave 5*a* and onwards up to a diverting pulley 12*a* in connection with the elevator car 1, after passing around the top of which diverting pulley onwards to its essentially immobile fixing point 15*a* that is below the elevator car 1 and that is provided with a prestressing element, such as a spring, to which fixing point the second end of the traction means 7*a* is fixed.

Correspondingly, the second traction means 7*b* is fixed at its first end to an essentially immobile fixing point 14*b* that is below the elevator car 1 and that is provided with a prestressing element, such as a spring, from where the traction means 7*b* is led to the diverting pulley 11*b* that is in connection with the compensating weight 2*b*, after passing over which diverting pulley the traction means 7*b* is led downwards to pass under the diverting pulley 9*a* that is below the elevator car 1 and onwards around the bottom of the second traction sheave 5*a* belonging to the hoisting machine 6, after which the second traction means 7*b* is led onwards up to a diverting pulley 12*b* in connection with the elevator car 1, after passing around the top of which diverting pulley onwards to its essentially immobile fixing point 15*b* that is below the elevator car 1 and that is provided with a prestressing element, such as a spring, to which the second end of the traction means 7*b* is fixed. In FIG. 6 the positions of the fixing points 15*a*, 15*b* have been shifted from the correct position to the side for the sake of clarity so that both fixing points are visible.

FIG. 7 presents a top view of a hoisting machine 6, with the traction sheaves 5, 5*a*, of an arrangement according to FIG. 6. The first traction sheave 5 is fixed directly to the shaft of the hoisting machine 6, and the second traction sheave 5*a* is mounted on bearings allowing free rotation. The traction sheaves 5 and 5*a* are further connected to each other via a toothed belt 13, which synchronizes the speeds of rotation of the traction sheaves 5, 5*a* so that they are the same.

FIGS. 4-7 present an elevator arrangement according to the invention, in which the elevator car 1 and one or more compensating weights 2*a*, 2*b* are supported with a 1:1 suspension and, correspondingly, 2:1 is selected as the pulling ratio of the traction means 7*a*, 7*b*.

FIGS. 7*a* and 7*b* present a simplified and diagrammatic view of one more elevator arrangement according to the invention, wherein the hoisting machine 6 of the elevator is disposed in the bottom part of the elevator hoistway, or close to it. FIG. 7*a* presents the solution as viewed from the side, and FIG. 7*b* the same solution as viewed from the top of the hoisting machine 6. For the sake of clarity the compensating weights 2*a*, 2*b* are presented in FIG. 7*b* with dot-and-dash lines.

In the arrangement according to FIGS. 7*a* and 7*b* the traction means 7*a* and 7*b* are led to pass from the compensating weights 2*a* and 2*b* to the elevator car 1 directly via the traction sheaves 5, which traction sheaves 5 are connected to a hoisting machine 6 via a shaft 6*a*. In the arrangement according to FIGS. 7*a* and 7*b* the traction sheaves 5 with their shafts 6*a* rotate in different directions to each other, but the arrangement can be implemented also such that both the traction sheaves 5 rotate in the same direction. From FIG. 7*b* it is seen that the hoisting machine 6 and its shaft 6*a* are at some certain angle with respect to the compensating weights 2*a*, 2*b* and their guide rail line. This angle can, however, vary, depending on the respective elevator layout solution. In this way a very shallow and simple machine solution is achieved without diverting pulleys in the bottom part of the hoistway, which solution reduces the space requirement in the bottom part of the hoistway and enables driving of the elevator car to as far down as possible.

FIG. 8 presents a front view and FIG. 9 a top view of one elevator arrangement according to the invention, wherein the hoisting machine, with traction sheave 5, of the elevator is disposed in the bottom part of the elevator hoistway, or close to it. In this case the compensating weight 2 is divided into two parts and disposed symmetrically on both sides of the car guide rail 16 between the side wall of the elevator car 1 and the wall of the hoistway. The use of a compensating weight differs from a counterweight in that a compensating weight saves energy by balancing the mass of the car and the load, whereas the purpose of a counterweight is to achieve sufficient friction between the traction sheave and the elevator ropes. The supporting rope 3 between the elevator car 1 and the compensating weights 2 is guided to travel via the diverting pulleys 4 downwards to the elevator car to as good a location as possible from the viewpoint of the balance of the car and the forces exerted on the guide rails 16. Correspondingly, the toothed belts or corresponding means that are the traction means 7 are led from the compensating weights 2 via diverting pulleys to the traction sheave 5 in the bottom part of the hoistway and from there onwards up to the elevator car 1. A compensating weight 2 divided thus into parts is suitably small and narrow and it can be disposed easily in the best possible location from the viewpoint of space and layout. In the arrangement according to FIGS. 8 and 9 some of the diverting pulleys 4 in the top part of the hoistway are above the projection of the elevator car 1. This type of solution is possible e.g. in those cases in which the machine room is above the elevator hoistway and these diverting pulleys 4 are in the machine room and therefore not in the elevator hoistway directly above the projection of the elevator car 1. Likewise, the solution is possible when the diverting pulleys are in a pulley room or secured in the hoistway.

FIG. 10 presents a side view and FIG. 11 a top view of one second elevator arrangement according to the invention, wherein the hoisting machine, with traction sheave 5, of the elevator is also disposed in the bottom part of the elevator hoistway, or close to it. In this solution one or more compensating weights 2 are disposed between the rear wall of the elevator car 1 and the wall of the elevator hoistway and the diverting pulleys above are disposed to the sides of the projection of the elevator car such that when viewed from above the diverting pulleys 4 are not above the projection of the elevator car 1. This is a highly space-efficient solution and also an advantageous solution from the viewpoint of the top clearance, and it enables a low top clearance, in which case the elevator car 1 can rise to quite close to the ceiling of the elevator hoistway even though the diverting pulleys 4 of the support means 3 are in the elevator hoistway. This type of space-efficient solution enables, e.g. in connection with modernization when an old rope elevator is taken out, that in connection with the modernization the size of the elevator car can be increased in the same elevator hoistway.

FIG. 12 presents a front view and FIG. 13 a top view of one more elevator arrangement according to the invention, wherein the hoisting machine, with traction sheave 5, of the elevator is also disposed in the bottom part of the elevator hoistway, or close to it. This solution differs from the solution according to FIGS. 8 and 9 in that here also the diverting pulleys 4 and 4*a* in the top part of the hoistway are disposed to the side of the projection of the car. Additionally, the diverting pulleys 4 and 4*a* are disposed such that when viewed from above their fixing points to the elevator car are symmetrical in relation to the center point of the car. Thus, for example, the diverting pulley 4 turning the suspension rope to the elevator car 1 on the side of the compensating weights 2 is on the front side of the guide rail line and, correspondingly, the diverting pulley 4*a* turning the suspension rope to the elevator car 1 on the opposite side to the compensating weights 2 is just as much on the rear side of the guide rail line.

FIG. 14 presents a front view and FIG. 15 a top view of one more elevator arrangement according to the invention, wherein the hoisting machine, with traction sheave 5, of the elevator is also disposed in the bottom part of the elevator hoistway, or close to it. In this solution the elevator car 1 is suspended supported by support means 3 such that the suspension ratio of the supporting becomes 2:1, whereas the traction means 7 are configured with a direct 1:1 ratio. In this solution the support means 3 are fixed at their first ends to the ceiling of the hoistway or to a fixing point near the ceiling in the top part of the hoistway and led downwards to one or more compensating weights 2, after passing around the bottom of the diverting pulleys 4*b* on it/them is led onwards over the diverting pulleys 4 in the top part of the hoistway and onwards below the elevator car 1 under the diverting pulleys 4*c* and finally to the top part of the hoistway, where the support means 3 are fixed at their second ends to the ceiling of the hoistway or to a fixing point near the ceiling in the top part of the hoistway.

The suspension ratio of the support means 3 can be greater than 2:1, e.g. 4:1 or 6:1, in which case thin ropes can be used as the support means 3 and the diverting pulleys 4, 4*b* and 4*c* can be smaller in their diameter. In addition, the elevator arrangement can also be made to be such that the supporting is 1:1 but the traction is 2:1, 4:1 or 6:1.

FIG. 16 presents a front view and FIG. 17 a top view of one more elevator arrangement according to the invention, wherein the hoisting machine, with traction sheave 5, of the elevator is also disposed in the bottom part of the elevator hoistway, or close to it. The traction means 7 between the compensating weight 2 and the elevator car 1 comprises at least two toothed belts and the support means 3 between the elevator car 1 and the compensating weight 2 is in this solution also a plurality of suspension ropes, which pass around the top of one or more diverting pulleys 4 in the top part of the elevator hoistway. In the solution presented in FIGS. 16 and 17 the support means 3 are fixed to the support member 1*a* of the elevator car 1 in the space between the compensating weight 2 and the elevator car 1.

FIG. 18 presents a front view and FIG. 19 a top view of one more elevator arrangement according to the invention, wherein the hoisting machine, with traction sheave 5, of the elevator is also disposed in the bottom part of the elevator hoistway, or close to it. This arrangement is otherwise similar to the arrangement according to FIGS. 16 and 17, but instead of one compensating weight 2 here there are two compensating weights and 2*c*, which are disposed on the same side of the side wall of the elevator car 1. The first compensating weight 2 is suspended in the same way as in the arrangement according to FIGS. 16 and 17 and the second compensating weight 2*c* is suspended beside the first compensating weight 2 by the aid of the diverting pulleys 4 and 4*a* in the top part of the hoistway, which diverting pulleys are placed in an angled line such that the diverting pulley 4 is partly above the second compensating weight 2*c* and the diverting pulley 4*a* is on the opposite side of the compensating weights such that the support means 3 descending to the elevator car 1 from the diverting pulley 4*a* is on the same center line of the elevator car as the support means 3 of the compensating weight 2 descending to the elevator car 1 from the diverting pulley 4. In this way the suspension of the elevator car 1 is very well balanced and the forces on the guide rails 16 are small.

FIGS. 20 and 21 present top views of more elevator arrangements according to the invention, wherein the hoisting machine, with traction sheave 5, of the elevator is also disposed in the bottom part of the elevator hoistway, or close to it. These arrangements are otherwise similar to the arrangements according to FIGS. 16-19, but instead of one or two compensating weights 2 here there are three compensating weights 2 and 2*c*, which are disposed on the same side of the side wall of the elevator car 1. The first compensating weight 2 is e.g. to some extent larger than the extra second and third compensating weight 2*c*. In the solution according to FIG. 20 the diverting pulleys 4 of the support means 3 in the top part of the elevator hoistway are all on the same side at the side of the elevator car 1 and the support means are all fixed to the elevator car 1 on the same side. Correspondingly, in the solution according to FIG. 21 the first diverting pulleys 4 of the support means 3 in the top part of the elevator hoistway are all on the same side at the side of the elevator car 1 and the second diverting pulleys 4*a* of the second and of the third compensating weight 2*c* are on the opposite side of the elevator car 1 symmetrically to each other with respect to the depth direction of the elevator car 1. In addition, the diverting pulleys 4*a* on the opposite side to the compensating weights 2, 2*c* are disposed such that the support means 3 descending to the elevator car 1 from the diverting pulleys 4*a* are on essentially the same center line of the elevator car as the support means 3 of the first compensating weight 2 descending to the elevator car from the diverting pulley 4. In this way the suspension of the elevator car 1 is very well balanced and the forces on the guide rails 16 are small.

In the arrangements according to FIGS. 16-21, in connection with modernization a normal rope elevator with machine room at the top can be modernized in the arrangement according to the invention e.g. such that the old machine is removed from use and the old traction sheave is left in place as a diverting pulley, or a new diverting pulley 4 is fixed into the position of the old traction sheave, and also the old elevator ropes are left as support means 3. Additionally, the new machine 6, with traction sheave 5, is installed in the bottom part of the hoistway and at least two toothed belts or corresponding traction means are arranged as a traction means 7 for being driven by the machine 6, and such that the first ends of the traction means 7 are connected to the compensating weights 2 from below and the second ends to the elevator car 1 from below, and that the traction means 7 pass around at least one traction sheave 5 for at least a part of the distance of the circumference.

The solutions according to FIGS. 16-21 are also well suited as a modernization arrangement e.g. in a low-rise building, in which there has been a hydraulic elevator. This type of elevator is e.g. a so-called rucksack elevator, wherein the elevator car 1 is suspended from the bottom and from one side supported by an L-shaped support member la. In hydraulic elevators, the elevator car 1 must be heavy enough for the elevator car to easily move also downwards against the hydraulic pressure. In connection with modernization the hydraulic power unit, with cylinder, is removed and in its place are put one or more compensating weights 2 and also in the bottom part of the elevator hoistway, or in the immediate proximity of the hoistway, an electrically-operated hoisting machine 6 with traction sheave 5 and the necessary diverting pulleys and also traction means 7. Correspondingly, disposed in the top part of the elevator hoistway are the support means 3, with diverting pulleys 4, 4*a*, fixed to the elevator car 1 and to the compensating weights 2. At its simplest a modernization solution for a hydraulic elevator is presented in e.g. FIGS. 16-17. If the elevator car has been larger and heavier, more compensating weights are needed. The solutions of e.g. FIGS. 18-21 present these solutions. In the solutions according to FIGS. 16-21 the traction means 7 are connected between the elevator car 1 and the first compensating weight 2. The other extra compensating weights 2*c* are not connected to the traction means 7.

Since the support means 3 are led by the aid of the diverting pulleys 4*a* also to the other side of the elevator car 1, the center points of mass can be situated as correctly as possible, owing to which the guide rail forces exerted on the guide rails 16 of the elevator car 1 can be balanced extremely well, which in turn improves the quality, durability and ride comfort of the elevator. Additionally, in the arrangement according to the invention, when modernizing a hydraulic elevator into an elevator solution according to the invention, the loadability of the elevator can be increased in relation to the surface area of the elevator hoistway, which further improves the capacity of the elevator.

Hydraulic elevators often have a power unit room and a power unit in the bottom part of the elevator hoistway, but at the side of the elevator hoistway. In connection with modernization, this space also can be utilized and a new electric machine 6 with traction sheave can be disposed in this ready machine space. The passage of the traction means 7 must in this case be led via additional diverting pulleys to the compensating weight 2 and to the elevator car 1, but these diverting pulleys can be small and inexpensive because the traction means 7 do not participate in supporting the elevator car 1 and the compensating weight 2, in which case the traction means 7 can be e.g. a toothed belt or corresponding. The power unit room can also be under the elevator hoistway, in which case the power unit room is separated from the elevator hoistway.

FIG. 22 presents a front view of one more elevator arrangement according to the invention, comprising two hoisting machines 6 of the elevator, which, with the traction sheaves 5, are disposed in the bottom part of the elevator hoistway, or close to it. The first hoisting machine 6 is fitted between one or more compensating weights 2 and the elevator car 1 on one side of the elevator car 1, and the second hoisting machine 6 is fitted between one or more compensating weights 2 and the elevator car 1 on a second side of the elevator car 1. This solution enables the base of the elevator hoistway to be made level, particularly in its center part, and the lifting mechanics can be made simple.

FIG. 23 presents a simplified and diagrammatic view of one elevator arrangement according to the invention, in the installation phase. In the case according to the example the completed elevator comprises two balancing weights. When the elevator hoistway is sufficiently ready, a control unit is brought to near the bottom part of the hoistway, to which control unit the necessary electric cabling is led and after that a hoisting machine package that is as far as possible pre-assembled at the factory is brought to the base of the hoistway and installed into its position, which package comprises at least a hoisting machine 6 as well as a traction sheave 5 and the necessary diverting pulleys. Before installation of the elevator car 1, e.g. three lifting hooks 17 are fixed to the ceiling of the hoistway, or close to it, on which hooks the diverting pulleys 4 and the overspeed governor, with its diverting pulleys and ropes, intended for the final use of the elevator are temporarily suspended. After this the lowest guide rails 16*a* and the elevator car 1, which is disposed on the completed guide rails 16*a*, are installed. The support means 3 of the elevator car 1 are fixed at their first end to the elevator car 1 and led over the top of diverting pulleys 4 on hooks 17 in the top part of the hoistway back downwards to the bottom part of the hoistway, where the support means 3 are fixed at their second end with fixing means 18 to the first end of traction elements 7 fitted onto the traction sheave 5, the second end of which traction elements 7 is fixed to the elevator car 1 from below. In this way the support means 3 and the traction means 7 form an unbroken loop, which is driven with the hoisting machine 6 intended for the final use of the elevator. Additionally, the safety gears of the elevator car are connected to the rope of an overspeed governor. FIG. 23 presents this installation situation.

Subsequently, the next-to-lowest guide rails are fixed as an extension of the lowest guide rails 16*a* and the elevator car is lifted upwards supported by the hooks 17 with the elevator's own hoisting machine 6 and the installation is performed upwards one stage at a time in a jump-lift manner until the topmost guide rails are in their position. After this the diverting pulleys 4 at the top are installed into their final position at the top end of the guide rails 16 and the overspeed governor is installed finally into its position and also the joint 18 between the support means 3 and the traction means 7 is disassembled and also the compensating weights 2 are installed into their positions between the support means 3 and the traction means 7, after which the support means 3 are fixed to the compensating weights 2 at their second ends and the traction means 7 at their first ends. After this installation continues in the different stages for bringing the elevator to completion.

In the arrangements according to FIGS. 1, 2, 3, 6, 7 and 8-23 the traction means 7, 7*a*, 7*b* can be either a plurality of parallel hoisting ropes, a chain or a belt, e.g. a toothed belt. Correspondingly, in the solution according to FIGS. 4 and 5 a belt cannot be used, so that the traction means 7*a*, 7*b* is a plurality of parallel hoisting ropes or one or more chains.

In the elevator arrangement according to the invention the supporting of the elevator car 1 is separated from the moving means of the elevator car and smart materials, such as toothed belts, in which traction is not based on friction but instead on shape-locking, suited to the purpose are used as the moving means, i.e. as the traction means 7, 7*a*, 7*b*. Since the traction is not based on friction, one or more compensating weights 2, 2*a*, 2*b*, 2*c* can be used instead of counterweights, which compensating weights are disposed in the elevator hoistway space-efficiently in relation to the cross-section of the elevator hoistway and their mass is optimized according to the use of the elevator such that the elevator arrangement is made to function in the best possible way in relation to energy efficiency in exactly the use for which it has been delivered. By proceeding in this manner the use of a new or modernized elevator is monitored initially after installation of the elevator and according to the monitoring results the balancing is adjusted e.g. within such limits that the aggregate mass of the compensating weights 2-2*c* is some suitable value between −10 . . . 60% of the rated load of the elevator, preferably e.g. some suitable value between 0 . . . 50% of the rated load of the elevator. An elevator arrangement designed and optimized in this manner moves an imposed load as energy-efficiently as is possible. The aforementioned space efficiency can be further improved with traction sheaves and diverting pulleys that are small in diameter and that can be disposed in small spaces.

A spring element enabling pretensioning is described in connection with the fixing point at each end of the traction means 7, 7*a*, 7*b* presented in the figures. A corresponding function can be implemented actively with so-called constant-force tensioning means, which ensure that the traction means 7, 7*a*, 7*b* used remain sufficiently taut all the time.

In the solutions according to FIGS. 1-7, 10-17 and 20-22 the diverting pulleys 4, 4*a* in the top part of the elevator hoistway are disposed in the height direction of the elevator hoistway particularly space-efficiently to enable a small top clearance. In this case they are disposed outside the projection of the elevator car 1 such that the top edge of the elevator car 1 in its upper position can drive between the diverting pulleys 4, 4*a* or even past the diverting pulleys 4, 4*a* to above them. Correspondingly, in the solutions according to FIGS. 18, 19 and 21 the diverting pulleys 4, 4*a* in the machine room or in the pulley room enable a small top clearance and driving of the elevator car 1 as far upwards as possible in the elevator hoistway.

It should also be noted that the different solutions presented above can be inventive features together with one or more other features of the invention.

It is obvious to the person skilled in the art that the invention is not limited solely to the examples described above, but that it may be varied within the scope of the claims presented below. Thus, for example, the suspension solutions can be different to what is presented above.

It is further obvious to the person skilled in the art that the location of the hoisting machine can be elsewhere than what is presented above in the drawings. The hoisting machine can be on the base of the elevator hoistway, or close to the base, but also on some side of the elevator hoistway and also in the top part of the elevator hoistway.

It is also obvious to the person skilled in the art that the number of compensating weights can also be greater than two or three. There can be e.g. four, six, eight, ten or even more compensating weights disposed in a different manner.

The invention claimed is:

1. An elevator arrangement, comprising:

a hoisting machine arranged in an elevator hoistway, the hoisting machine having one or more traction sheaves;

an elevator car and one or more compensating weights configured to move in the elevator hoistway, the one or more compensating weights being connected to support the elevator car via one or more support members and one or more diverting pulleys; and one or more traction members configured to transmit rotational movement of the one or more traction sheaves into movement of the elevator car and the one or more compensating weights; wherein the one or more traction members are separate from the one or more support members, each of the one or more compensating weights is connected to the hoisting machine via a respective traction member from among the one or more traction members, a first end of the one or more traction members is fixed at a first fixing point below the elevator car, and a second end of the one or more traction members is fixed at a second fixing point below the elevator car.

2. An elevator arrangement, comprising:

a hoisting machine arranged in an elevator hoistway, the hoisting machine having one or more traction sheaves;

an elevator car configured to move in the elevator hoistway;

one or more compensating weights supporting the elevator car via one or more support members and one or more diverting pulleys, the one or more support members not touching the one or more traction sheaves; and one or more traction members configured to transmit rotational movement of the one or more traction sheaves into movement of the elevator car and the one or more compensating weights; wherein each of the one or more compensating weights is connected to the hoisting machine by a traction member from among the one or more traction members, a first end of the one or more traction members is fixed at a first fixing point below the elevator car, and a second end of the one or more traction members is fixed at a second fixing point below the elevator car.

3. The elevator arrangement of claim 2, wherein the one or more support members include a rope or belt.

4. The elevator arrangement of claim 2, wherein the one or more traction members include a rope, chain or belt.

5. The elevator arrangement according to claim 1, wherein at least two compensating weights are connected to the hoisting machine via corresponding ones of the one or more traction members.

6. The elevator arrangement according to claim 5, wherein a first of the one or more traction sheaves includes a contact surface for each of the one or more traction members.

7. A method of operating an elevator arrangement according to claim 1, the elevator arrangement further including an elevator, and the method comprising:

monitoring use of the elevator initially after installation of the elevator arrangement; and adjusting a balance of the elevator according to monitoring results by selecting a value less than about 60% of a rated load of the elevator as an aggregate mass of the one or more compensating weights.

8. The elevator arrangement of claim 7, wherein the selected value is greater than 0%, but less than or equal to about 50% of the rated load of the new or modernized elevator.

9. The elevator arrangement according to claim 1, wherein the plane of rotation of the one or more traction sheaves is in a horizontal plane.

10. The elevator arrangement according to claim 1, wherein:

the hoisting machine includes two traction sheaves connected to each other via a synchronization member;

the one or more traction members include a first traction member and a second traction member; and the first and second traction members pass around both of the two traction sheaves.

11. The elevator arrangement according to claim 1, wherein:

the one or more traction members includes a first traction member and a second traction member;

the first end of the one or more traction members is a first end of the first traction member;

the second end of the one or more traction members is a second end of the first traction member;

from the first fixing point, the first traction member is led to a first of the one or more diverting pulleys fixed to a first of the one or more compensating weights, passes over the first of the one or more diverting pulleys, is led downward to pass under a second of the one or more diverting pulleys below the elevator car, around a top of a first of the one or more traction sheaves, around a bottom of a second of the one or more traction sheaves, upward to a third of the one or more diverting pulleys fixed to the elevator car, and around a top of the third of the one or more diverting pulleys, to the second fixing point;

a first end of the second traction member is fixed at a third fixing point below the elevator car;

a second end of the second traction member is fixed at a fourth fixing point below the elevator car; and from the third fixing point, the second traction member is led to a fourth of the one or more diverting pulleys fixed to a second of the one or more compensating weights, passes over the fourth of the one or more diverting pulleys, is led downward to pass under a fifth of the one or more diverting pulleys below the elevator car, around the bottom of the second of the one or more traction sheaves, upwards to a sixth of the one or more diverting pulleys fixed to the elevator car, passes around a top of the sixth of the one or more diverting pulleys to the fourth fixing point.

12. The elevator arrangement according to claim 1, wherein:

the one or more support members are separated from the one or more traction members; and the one or more traction members are formed of smart materials in which traction is not based on friction, but instead on shape-locking.

13. The elevator arrangement according to claim 1, wherein:

the one or more compensating weights are in the elevator hoistway; and the mass of the one or more compensating weights is determined according to the use and energy consumption of the elevator arrangement.

14. The elevator arrangement according to claim 1, wherein:

at least one diverting pulley from among the one or more diverting pulleys is arranged in a top part of the elevator hoistway; and the at least one diverting pulley arranged in the top part of the elevator hoistway is configured such that a top edge of the elevator car is driven above the at least one diverting pulley at an upper position in the elevator hoistway.

15. A method of installing an elevator arrangement according to claim 1, the method comprising:

lifting the elevator car upwards in stages along guide rails by (i) the hoisting machine, (ii) at least one diverting pulley from among the one or more diverting pulleys that are suspended with hooks in a top part of the elevator hoistway, and (iii) the one or more support members;

connecting the one or more support members together with the one or more traction members;

moving the one or more traction members with the one or more traction sheaves; and arranging the hoisting machine in a bottom part of the hoistway.

16. The elevator arrangement of claim 1, wherein the one or more support members include a rope or belt.

17. The elevator arrangement of claim 1, wherein the one or more traction members include a rope, chain or belt.

18. An elevator arrangement comprising:

a hoisting machine arranged in an elevator hoistway, the hoisting machine having one or more traction sheaves;

an elevator car and one or more compensating weights configured to move in the elevator hoistway, the one or more compensating weights being connected to support the elevator car via one or more support members and one or more diverting pulleys; and one or more traction members configured to transmit rotational movement of the one or more traction sheaves into movement of the elevator car and the one or more compensating weights; wherein the one or more traction members are separate from the one or more support members, each of the one or more compensating weights is connected to the hoisting machine via a respective traction member from among the one or more traction members, the one or more traction members include a first traction member and a second traction member, the one or more compensating weights include a first compensating weight and a second compensating weight, the hoisting machine is below the elevator car a first end of the first traction member is fixed to the first compensating weight, a second end of the first traction member is fixed to the elevator car the first traction member extends downward from the first compensating weight, passes under a first of the one or more diverting pulleys, around a first of the one or more traction sheaves on a first contact surface on first side of the first of the one or more traction sheaves, under at least a second of the one or more diverting pulleys, and upward to the elevator car, a first end of the second traction member is fixed to the second compensating weight, a second end of the second traction member is fixed to the elevator car, and the second traction member extends downward from the second compensating weight, passes under at least a third of the one or more diverting pulleys, around the first of the one or more traction sheaves on a second contact surface on a second side of the first of the one or more traction sheaves, under at least a fourth of the one or more diverting pulleys, and upward to the elevator car.

19. An elevator arrangement comprising:

a hoisting machine arranged in an elevator hoistway, the hoisting machine having one or more traction sheaves;

an elevator car and one or more compensating weights configured to move in the elevator hoistway, the one or more compensating weights being connected to support the elevator car via one or more support members and one or more diverting pulleys; and one or more traction members configured to transmit rotational movement of the one or more traction sheaves into movement of the elevator car and the one or more compensating weights; wherein the one or more traction members are separate from the one or more support members, each of the one or more compensating weights is connected to the hoisting machine via a respective traction member from among the one or more traction members, the one or more traction members include a first traction member, the one or more traction sheaves include two traction sheaves, a first end of the first traction member is fixed at a first fixing point below the elevator car, a second end of the first traction member is fixed at a second fixing point below the elevator car, and from the first fixing point, the first traction member is led to a first of the one or more diverting pulleys fixed to a first of the one or more compensating weights, passes over the first of the one or more diverting pulleys, is led downward to pass under a second of the one or more diverting pulleys below the elevator car, around the two traction sheaves to form an Extended Double Wrap loop, is led under a third of the one or more diverting pulleys below the elevator car to a fourth of the one or more diverting pulleys fixed to the elevator car, and passes around a top of the fourth of the one or more diverting pulleys to the second fixing point.

* * * * *